US007257926B1

(12) United States Patent
Kirby

(10) Patent No.: US 7,257,926 B1
(45) Date of Patent: Aug. 21, 2007

(54) TILE SPACER AND LEVELER

(76) Inventor: Mark E. Kirby, 2297 Jones Dr., Dunedin, FL (US) 34698

( * ) Notice: Subject to any disclaimer, the term of this patent is extended or adjusted under 35 U.S.C. 154(b) by 0 days.

(21) Appl. No.: 11/466,947

(22) Filed: Aug. 24, 2006

(51) Int. Cl.

| | |
|---|---|
| ***E04B 9/00*** | (2006.01) |
| ***E04B 1/00*** | (2006.01) |
| ***E04G 21/00*** | (2006.01) |
| ***E04G 23/00*** | (2006.01) |
| ***E04G 21/14*** | (2006.01) |
| ***E04D 15/00*** | (2006.01) |
| ***E04F 21/00*** | (2006.01) |
| ***G01B 1/00*** | (2006.01) |

(52) U.S. Cl. ..... 52/126.5; 52/749.11; 52/747.11; 33/526

(58) Field of Classification Search ..... 52/749.11, 52/747.11, DIG. 1, 126.1–126.7, 389–392; 33/526, 527, 613, 645
See application file for complete search history.

(56) References Cited

U.S. PATENT DOCUMENTS 4,397,125 A * 8/1983 Gussler, Jr. ..... 52/127.3
5,288,534 A * 2/1994 Tavshanjian ..... 428/64.1
5,359,783 A * 11/1994 Smith ..... 33/527
5,675,942 A * 10/1997 Crawford ..... 52/127.3
2005/0166483 A1* 8/2005 Mead ..... 52/126.7
2006/0185319 A1* 8/2006 Kufner et al. ..... 52/749.11

* cited by examiner

*Primary Examiner*—Robert Canfield
*Assistant Examiner*—Hunter M Dreidame
(74) *Attorney, Agent, or Firm*—Ronald E. Smith; Smith & Hopen, P.A.

(57) ABSTRACT

A method for installing tiles includes the steps of positioning a base in overlying relation to cementitious material. First and second spacer arms are formed on the base in normal relation to one another. Preselected corners of four tiles are positioned in overlying relation to the base and are spaced apart from one another by the spacer arms. A post having ratchet teeth is formed integrally with the base at the center of the base. A disc receives the post and a pawl formed in the disc prevents displacement of the disc away from the base. The disc is positioned in overlying relation to the four corners of the tiles so that it overlies and holds the tiles level between the base and the disc. After curing of the cementitious material, an installer twists the disc in a plane parallel to the tiles until the post breaks off.

3 Claims, 6 Drawing Sheets

TILE SPACER AND LEVELER

BACKGROUND OF THE INVENTION

1. Field of the Invention

This invention relates to methods for installing tile. More particularly, it relates to a tool that ensures that all tiles used in an installation will be properly spaced apart from one another and level with one another.

2. Description of the Prior Art

Positioning a large plurality of tiles on a floor in such a way that all of the tiles are properly aligned and spaced apart from one another and level relative to one another when the job is complete is a difficult task. Many tile installers fail, with the result that people trip over the upraised edges of non-level tile. The difficulty arises primarily from the fact that the cementitious mixture upon which the tiles are laid requires a curing time of about twenty four (24) hours. An installer might install the tiles in a level manner, and hold them for a while in an effort to ensure that they remain level as the cementitious material cures, but no one can manually hold the tiles overnight for the entire duration of the curing process. Accordingly, as the cementitious material expands, or contracts, and settles during the curing process, the final position of the tiles may be uneven.

Spacing the tiles apart from one another is also problematic. Most installers just align and space the tiles as best they can by relying upon the well-known "eyeballing" technique.

A device known commercially as the Marble Plane is capable of holding tiles level during the curing process. It may be seen at www.tile-eze.com.

There is a need, however, for a tile spacer and leveler that has a simple construction and that is easy to use. Such a tool would lower the skill level required to install tile. It would also reduce the time required to complete each job. Moreover, it would produce a more satisfactory tile surface in that the spacing of the tiles would be aesthetically pleasing and there would be no tripping hazards arising from tiles that are not level with their contiguous tiles.

However, in view of the art considered as a whole at the time the present invention was made, it was not obvious to those of ordinary skill in this art how the identified needs could be met.

SUMMARY OF INVENTION

The longstanding but heretofore unfulfilled need for a method for installing tiles so that the tiles are level and uniformly spaced with respect to one another is now met. The steps of the novel method include providing an elongate straight post having a plurality of small, closely spaced ratchet teeth formed therein along its length. The leading end of the post is formed integrally with a flat, disc-shaped base having a top surface and a bottom surface, and said post is centered with respect to said base. A first spacer arm is formed in the top surface of the base so that the first spacer arm is diametrically disposed relative to the top surface. The first spacer arm is formed integrally with the top surface and projects upwardly therefrom. A second spacer arm is also formed in the top surface of the base so that the second spacer arm is diametrically disposed relative to the top surface. The second spacer arm is also formed integrally with the top surface and projects upwardly therefrom in normal relation to the first spacer arm.

The first and second spacer arms intersect one another at a center of the top surface so that they share a common center. An opening is formed at said center to accommodate the leading end of the post that is formed integrally with said base. A plurality of equidistantly spaced openings is formed in each of the spacer arms along the respective extents thereof. These openings save materials and also admit cementitious material thereinto when the tiles are laid, thereby further securing the base to said cementitious material.

A top disc having about the same size as the base has a bore formed in its center. The bore receives the post that is formed integrally with the base. The lumen of the bore is formed into a pawl means so that said top disc is displaceable along the extent of the post in a first direction towards the base and not in a second direction away from the base.

A pair of diametrically opposed, upstanding handles is formed integrally with a top surface of the top disc. Various material-saving openings are also formed in the top disc. Unlike the openings formed in the base, no cementitious material enters into the openings formed in the top disc because the top disc overlies the tiles when in use and does not come into contact with the cementitious material.

A plurality of protrusions or legs is formed integrally with a bottom surface of the top disc in depending relation thereto and the protrusions are positioned in circumferentially and equidistantly spaced relation to one another about the periphery of said bottom surface. The legs share a common length and they rest in the space between contiguous tiles and atop the cementitious material when the inventive structure is in use.

The tile installation process begins with spreading a layer of cementitious material over the surface to be tiled. The base is then positioned in overlying relation to the cementitious material so that the material enters into the openings formed in the base but the material does not flow onto the top surface of the base. Preselected corners of four tiles are positioned in overlying relation to the base in abutting relation to the spacer arms so that the four tiles are spaced apart from one another by the first and second spacer arms. The movable top disc is positioned into overlying relation to the four corners of the four tiles so that the legs depending from the bottom surface of the top disc are positioned in the space between contiguous tiles and respectively overlie the cementitious material between said tiles.

The tiles are clamped tightly between the base and the legs of the movable top disc because the pawl means formed in the central opening of the movable top disc prevents the movable top disc from moving away from the base. The assembly is left in place overnight to allow time for curing of the cementitious material.

After the cementitious material has cured, an installer twists the top disc by engaging the top disc at the handles and rotating said top disc in a plane parallel to the surface of the tiles until the elongate straight post breaks off from the base, flush with the top surface of the base, below the surface of the cementitious material. The base is permanently disposed beneath the tiles when the installation is complete.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
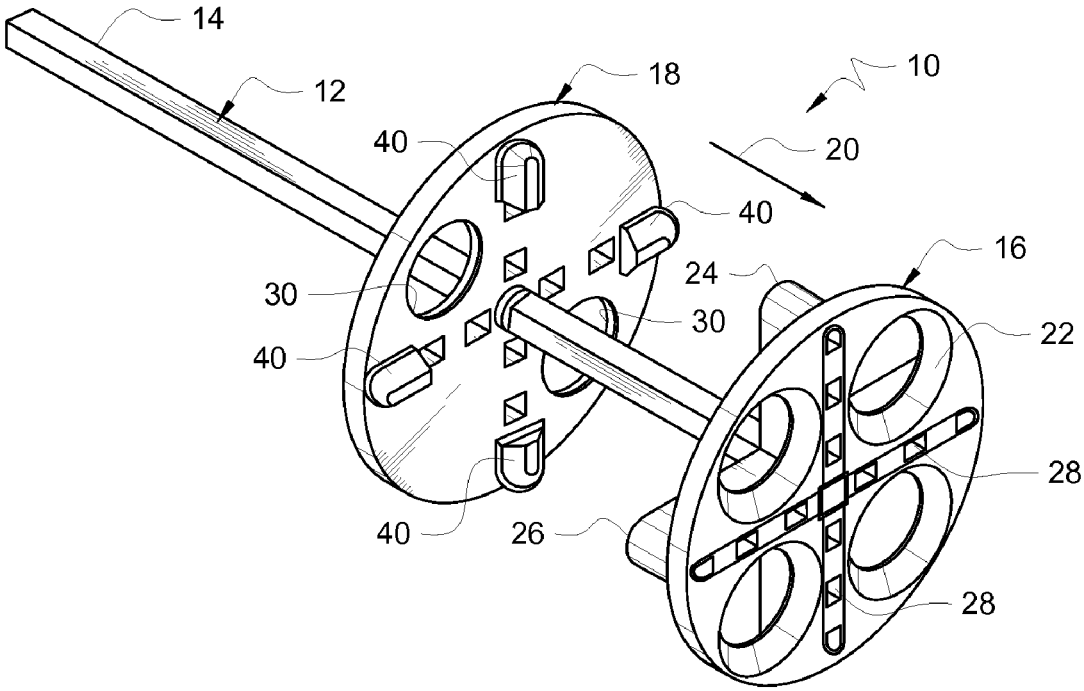
FIG. 1 is a bottom perspective view of the novel spacer and clamp assembly.

Referring now to FIG. 1, it will there be seen that a preferred embodiment of the invention is denoted as a whole by the reference numeral 10. Elongate straight post 12 has a plurality of small, very closely spaced ratchet teeth 14 formed therein along its length. Such ratchet teeth 14 are commonly found in flexible plastic ties where a pawl easily slides in a first direction relative to said teeth but cannot slide in a second direction that is opposite to said first direction. Such ties have numerous applications and are even used by police forces as handcuffs because they require no key-controlled lock. Post 12, however, is not flexible.

The lower end of post 14 is formed integrally with disc-shaped base 16 at the center of said base.

Movable top disc 18 is centrally apertured and a pawl means is formed in sidewalls of said central aperture to slidingly engage ratchet teeth 14 so that top disc 18 can be displaced in a first direction toward base 16 as indicated by directional arrow 20 and so that said disc 18 cannot travel in a direction opposite to said first direction.

Figure 2:
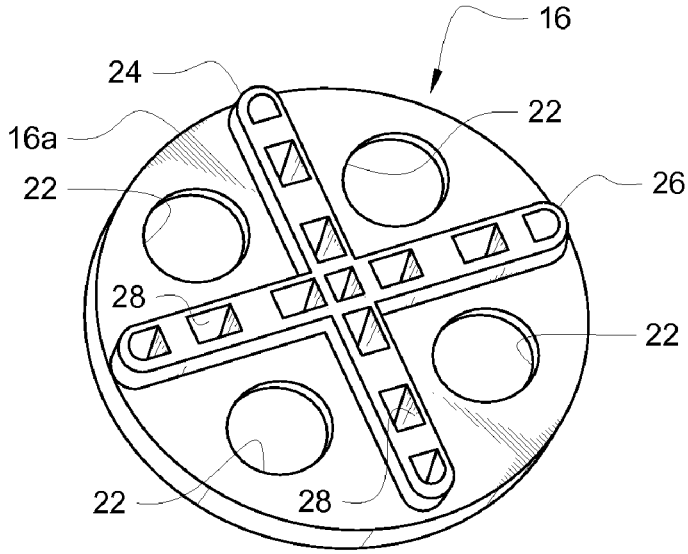
FIG. 2 is a top perspective view of the base of the novel tool.

Further structural details of base 16 are depicted in FIG. 2. Four (4) circumferentially and equidistantly spaced openings, collectively denoted 22, are formed in base 16 and extend therethrough. A spacer having arms 24 and 26 is formed in the top side 16*a* of said base and projects upwardly therefrom. More particularly, first arm 24 is diametrically disposed relative to said top side 16*a* as is second arm 26, and said first and second arms are disposed normal to one another so that they intersect one another at the center of top side 16*a*. Arms 24, 26 are integrally formed with top side 16*a* and with one another so that they share a common center as depicted. Said arms therefore collectively form a shape that looks like a plus sign (+) when seen in plan view. The spacer arms thus divide the base into four equal size areas having a common shape.

A plurality of equidistantly spaced square or rectangular openings, collectively denoted 28, is formed in each of said arms 24, 26, along the respective extents thereof. The opening formed in the center of spacer arms 24, 26 where said arms meet is adapted to receive the leading end of elongate post 12 as depicted in FIG. 1.

Figure 3:
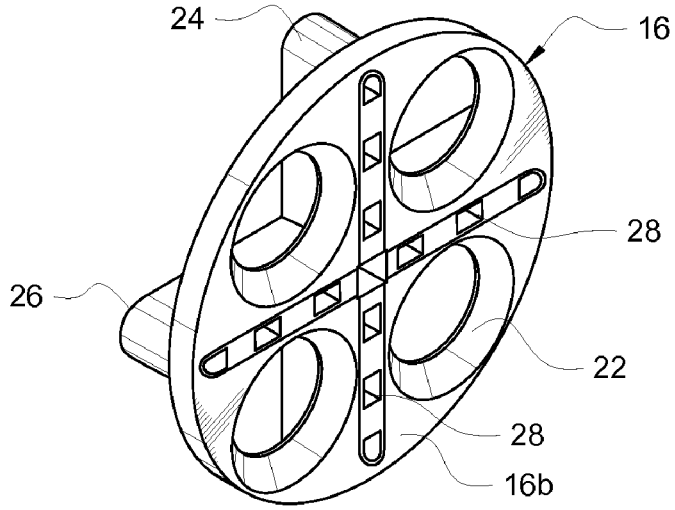
FIG. 3 is a bottom perspective view of said base.

FIG. 3 depicts bottom side 16*b* of base 16.

Figure 4A:
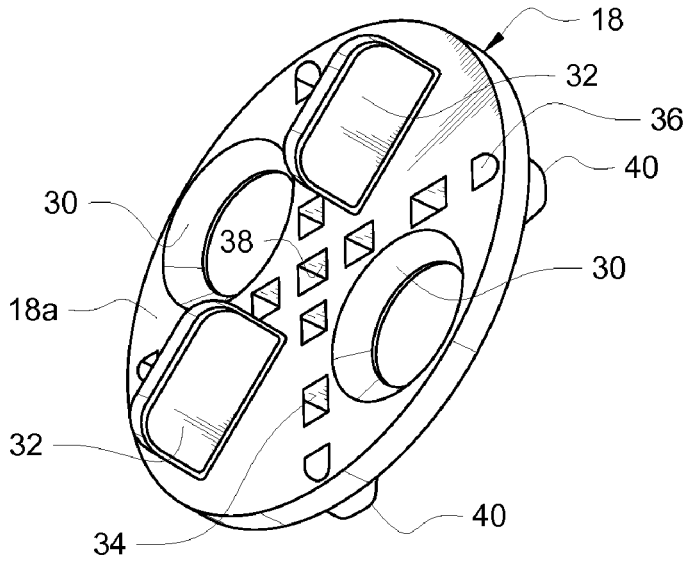
FIG. 4A is a top perspective view of the movable top disc of the novel tool.
Figure 4B:
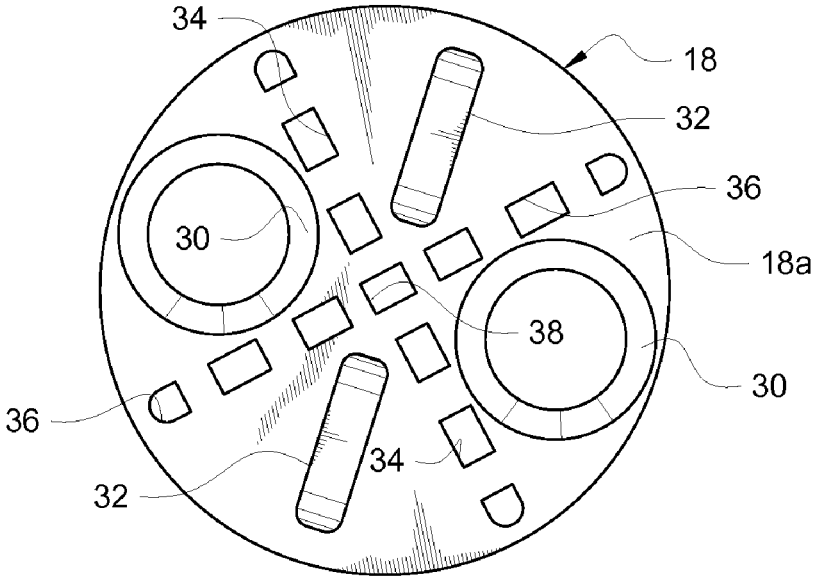
FIG. 4B is a top plan view of said movable top disc.

Movable top disc 18 is depicted in a top perspective view in FIG. 4A and in top plan view in FIG. 4B. A pair of circular, diametrically opposed material-savings openings is formed in disc 18 and denoted 30. A pair of diametrically opposed, upstanding handles is formed integrally with top surface 18*a* of disc 18 and is denoted 32. A first plurality of square or rectangular material-saving openings 34 extends diametrically across disc 18 and intersects with a second plurality of material-saving square or rectangular openings 36 that extends diametrically across disc 18 in normal relation to the first plurality of openings 34. Said first and second plurality of openings therefore share a common central opening, denoted 38. The pawl means mentioned earlier is formed in one or more sidewalls of said central opening 38, said pawl means being a plurality of teeth formed in one or more of said sidewalls that allow ratchet teeth 14 to slide thereover in a first direction indicated by directional arrow 20 in FIG. 1 but which prevent travel in a second direction opposite to said first direction as aforesaid. Two (2) protrusions or legs, collectively denoted 40, are barely visible in FIG. 4A.

Figure 5:
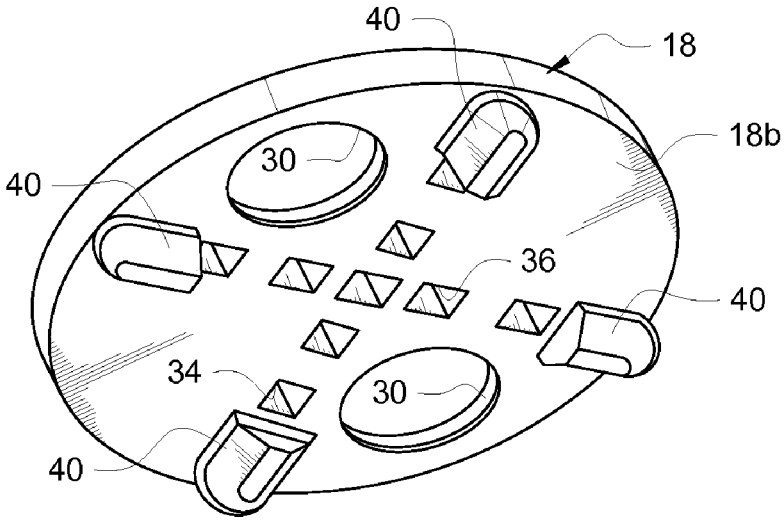
FIG. 5 is a bottom perspective view of said movable top disc.

All four (4) of said protrusions or legs 40 are illustrated in FIG. 5 which provides a bottom perspective view of movable top disc 18. Each of said protrusions is formed integrally with bottom side 18*b* of disc 18. The protrusions have a common length and are circumferentially and equidistantly spaced about the periphery of said bottom side 18*b*.

Figure 6:
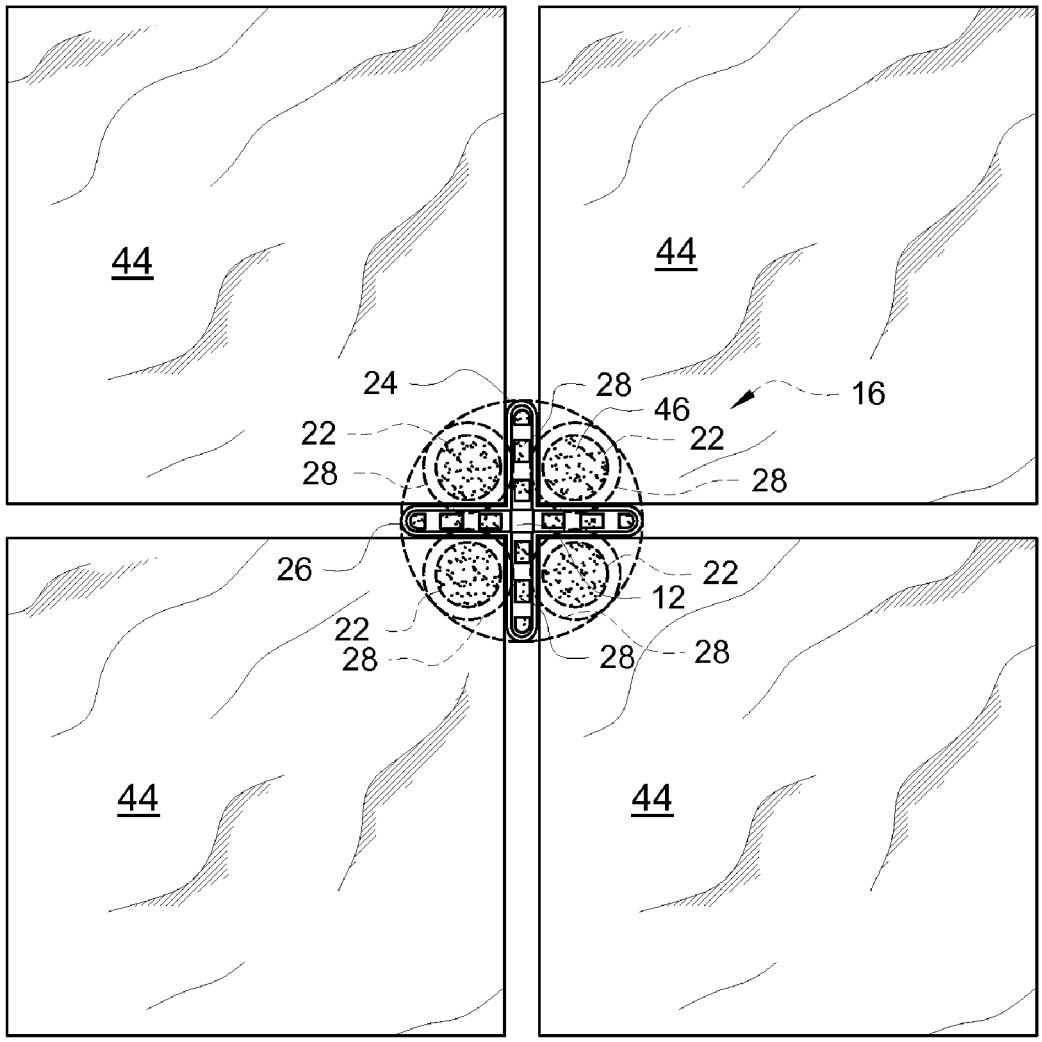
FIG. 6 is a top plan view of the base after tiles have been positioned in spaced relation to one another.

The remaining Figures depict the novel tool in use and the steps followed when using the tool. FIG. 6 depicts the respective corners of four (4) tiles, collectively denoted 44, positioned in overlying relation to top surface 16*a* of base 16. More particularly, each tile corner occupies one of the four equally sized, commonly shaped areas of base 16. Bottom surface 16*b* of base 16 is positioned in overlying relation to cementitious material 46. Spacer arms 24 and 26 perform their function of spacing the four tiles apart from one another in a perfectly aligned configuration because the spacer arms are straight and are disposed in normal relation to one another as aforesaid. Cementitious material 46 enters into each circular opening 22 and into each opening 28 formed in said spacer arms as well. Post 12 is disposed in central aperture 28. Although the four corners of four tiles are depicted, it is of course understood that the depicted parts are also provided at all four corners of each tile so that the entire tile assembly is a monolithic, evenly-spaced, level whole when all of the novel levelers/spacers are in their respective operative positions. It should be understood that the tiles are level with respect to one another. If installed on a floor that is not level, the tiles will be level with one another but the entire installation would then be out of level.

Figure 7:
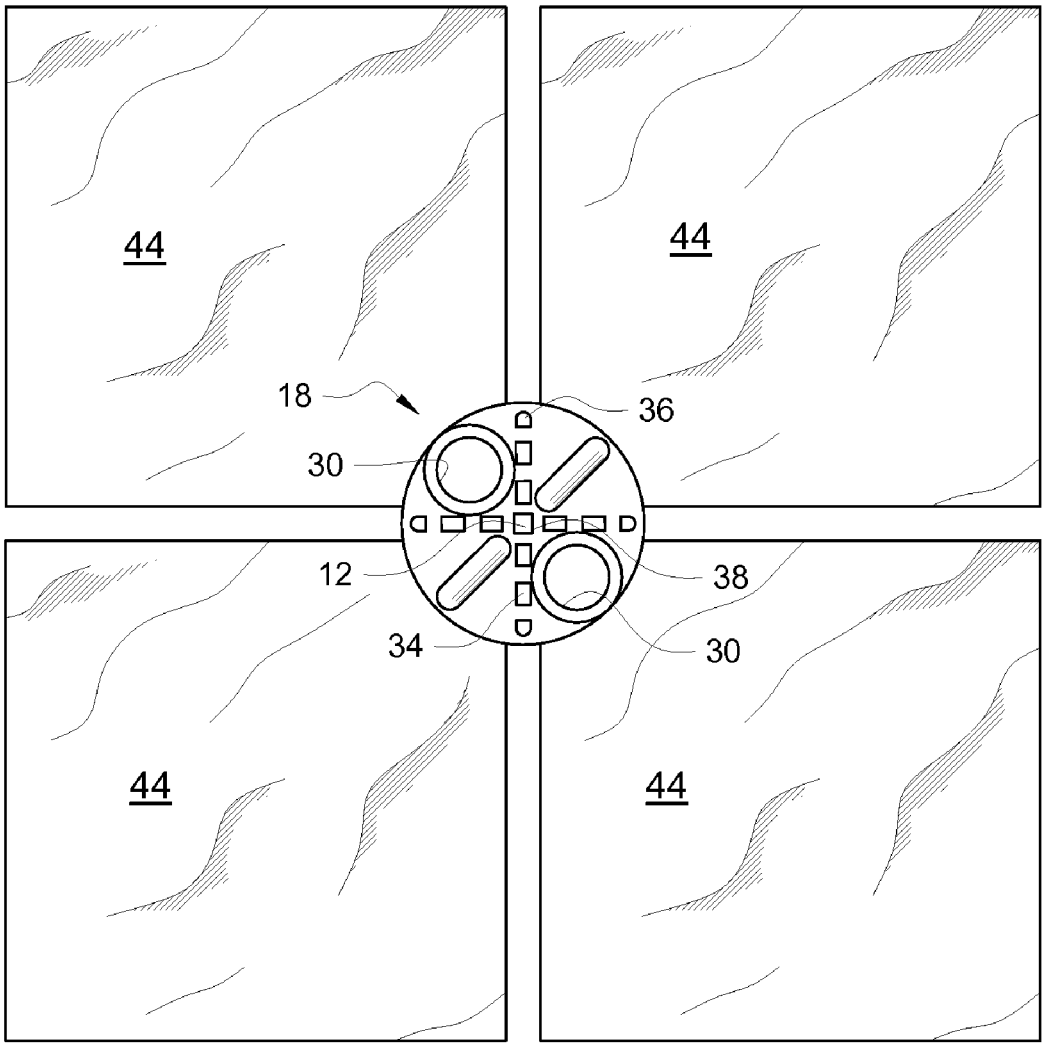
FIG. 7 is a top plan view of the parts depicted in FIG. 6 after the movable top disc has been lowered into its operable clamping position.

FIG. 7 depicts movable top disc 18 disposed in tightly pressed, overlying relation to tiles 44 so that legs 40 of said movable top disc are positioned in the space between contiguous tiles in abutting relation to the cementitious material. Tiles 44 are thus clamped tightly between base 16 and movable top disc 18 because the pawl means formed in the central opening of movable top disc 18 prevents said movable disc from moving upwardly.

Figure 8:
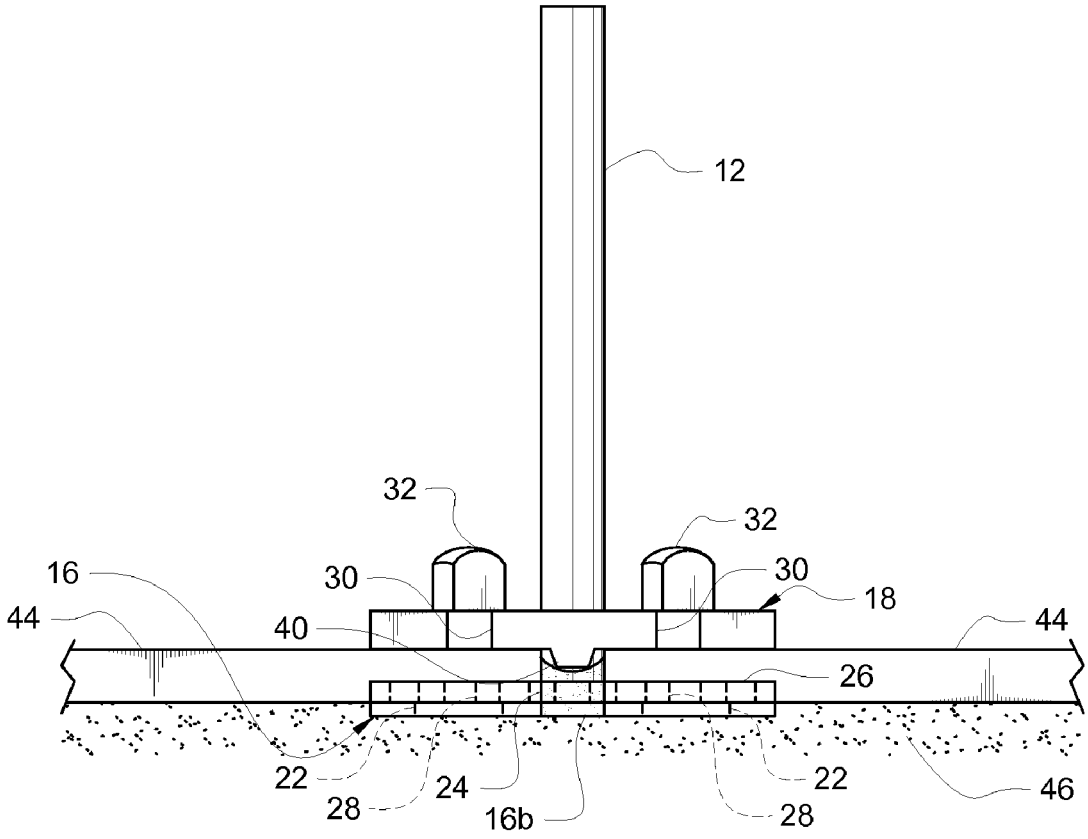
FIG. 8 is a side elevational view of the novel spacer and clamp assembly when it is in use during the time the cementitious material is curing.

FIG. 8 is a side elevational view depicting the same configuration of parts as depicted in FIG. 7. The parts are left in this configuration until the cementitious material cures. In most case, that amounts to leaving such parts in their FIG. 7 and FIG. 8 position overnight.

Figure 9:
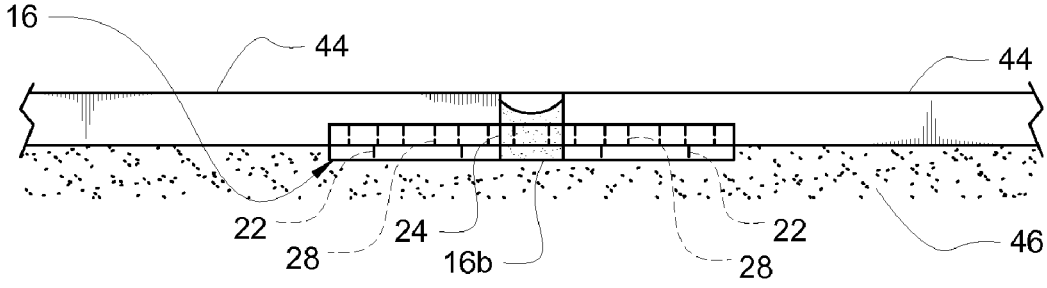
FIG. 9 is a side elevational view of the novel spacer and clamp assembly after the cementitious material has cured, the movable top disc has been rotated, and the post has been broken off at the top surface of the base.

FIG. 9 depicts the final tile installation in side elevation. Base 16 is permanently disposed beneath said tile. The installer has twisted handles 32, 32 of movable top disc 18 in a clockwise or counterclockwise direction in a plane parallel to the surface of the tiles. Post 12 has broken off flush with the top surface of base 16.

The novel method and apparatus thus lowers the skill required to produce a tile installation where the tiles are level with respect to one another and are perfectly spaced apart.

The amount of time required to produce a practically perfect installation is also reduced, thereby increasing the profits of the installer and the satisfaction of the customer.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A method for installing tiles so that the tiles are level and uniformly spaced with respect to one another, comprising the steps of:

providing an elongate straight post having a plurality of small, closely spaced ratchet teeth formed therein along its length;

providing a flat base having a top surface and a bottom surface;

providing a flat disc having a top surface and a bottom surface;

forming a first spacer arm in said top surface of said base so that said first spacer arm is diametrically disposed relative to said top surface, said first spacer arm being formed integrally with said top surface and projecting upwardly therefrom;

forming a second spacer arm in said top surface of said base so that said second spacer arm is diametrically disposed relative to said top surface, said second spacer arm being formed integrally with said top surface and projecting upwardly therefrom in normal relation to said first spacer arm;

said first and second spacer arms intersecting one another at a center of said top surface, said first and second spacer arms sharing a common center;

integrally forming a leading end of said elongate straight post to said base at said center on said top surface of said base;

forming a bore having a lumen in a center of said disc;

forming a pawl means in said lumen so that said disc is displaceable in a first direction towards said base and so that said disc is not displaceable is a second direction opposite to said first direction;

forming a pair of diametrically opposed, upstanding handles with said top surface of said disc; and forming a plurality of legs integrally with said bottom surface of said disc and positioning each leg of said plurality of legs in circumferentially and equidistantly spaced relation to one another about the periphery of said bottom surface of said base.

2. The method of claim 1, further comprising the steps of:

positioning said bottom surface of said base in overlying relation to a cementitious material;

positioning preselected corners of four tiles in overlying to said base so that said four tiles are spaced apart from one another by said first and second spacer arms;

positioning said disc in overlying relation to said four corners of said four tiles so that said legs of said disc are positioned between contiguous tiles and overlie the top surface of said cementitious material;

whereby said tiles are clamped tightly between said base and said disc because the pawl means formed in said central opening of said disc prevents said disc from moving away from said base;

whereby an installer twists said disc by engaging and rotating said disc at said handles in a plane parallel to the surface of the tiles until said post breaks off;

whereby said base is permanently disposed beneath said tiles when said installation is complete.

3. An apparatus having utility in the installation of tiles so that the tiles are level and uniformly spaced with respect to one another, comprising:

an elongate straight post having a plurality of small, closely spaced ratchet teeth formed therein along its length;

a flat base having a top surface and a bottom surface;

said elongate straight post having a leading end formed integrally with said flat base at a center of said flat base;

a first spacer arm positioned on said top surface of said flat base so that said first spacer arm is diametrically disposed relative to said top surface, said first spacer arm projecting upwardly from said top surface of said flat base;

a second spacer arm positioned on said top surface of said base so that said second spacer arm is diametrically disposed relative to said top surface, said second spacer arm projecting upwardly from said top surface in normal relation to said first spacer arm;

said first and second spacer arms being disposed in intersecting relation to one another at a center of said top surface so that said first and second spacer arms share a common center;

said first and second spacer arms dividing said base into four equal size areas of common shape, each of said areas adapted to receive a corner of a tile;

a disc having a central opening formed therein;

a pawl means formed in said central opening so that said disc is displaceable in a first direction towards said base and so that said disc is not displaceable in a second direction away from said base;

a pair of diametrically opposed, upstanding handles secured to said top surface of said disc; and a plurality of protrusions formed integrally with said bottom surface of said disc, each protrusion of said plurality of protrusions being positioned in circumferentially and equidistantly spaced relation to one another about the periphery of said bottom surface of said base;

said protrusions adapted to be disposed in a space between contiguous tiles when said disc is displaced along the extent of said post towards said base until said tiles prevent further displacement of said disc;

whereby tiles are clamped between said base and said disc.

* * * * *